US010665372B2

(12) United States Patent
Takeda et al.

(10) Patent No.: US 10,665,372 B2
(45) Date of Patent: May 26, 2020

(54) ELECTRICAL STEEL SHEET AND MANUFACTURING METHOD THEREOF

(71) Applicant: Nippon Steel & Sumitomo Metal Corporation, Tokyo (JP)

(72) Inventors: Kazutoshi Takeda, Tokyo (JP); Kenji Kosuge, Tokyo (JP); Tatsuya Takase, Tokyo (JP); Hiroyasu Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 87 days.

(21) Appl. No.: 15/962,701

(22) Filed: Apr. 25, 2018

(65) Prior Publication Data

US 2018/0240579 A1 Aug. 23, 2018

Related U.S. Application Data

(62) Division of application No. 13/128,302, filed as application No. PCT/JP2009/069109 on Nov. 10, 2009, now Pat. No. 9,984,801.

(30) Foreign Application Priority Data

Nov. 27, 2008 (JP) ..... 2008-302233

(51) Int. Cl.

| | |
|---|---|
| ***H01F 1/18*** | (2006.01) |
| ***C23C 22/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *H01F 1/18* (2013.01); *C22C 38/02* (2013.01); *C22C 38/04* (2013.01); *C22C 38/06* (2013.01); *Y10T 428/31678* (2015.04); *Y10T 428/31681* (2015.04)

(58) Field of Classification Search

None

See application file for complete search history.

(56) References Cited

U.S. PATENT DOCUMENTS

| | | | |
|---|---|---|---|
| 4,554,213 | A | 11/1985 | Marini et al. |
| 5,137,567 | A | 8/1992 | Aubareda Vallvey et al. |
| 5,753,740 | A | 5/1998 | Odawa et al. |
| 5,891,515 | A | 4/1999 | Dutheil et al. |
| 5,945,212 | A | 8/1999 | Tanaka et al. |
| 6,159,534 | A | 12/2000 | Takeda |
| 6,277,220 | B1 | 8/2001 | Hamada et al. |
| 6,383,650 | B1 | 5/2002 | Takeda |
| 6,667,105 | B1 | 12/2003 | Yoo et al. |
| 6,833,398 | B2 | 12/2004 | Agarwal et al. |
| 7,998,284 | B2 | 8/2011 | Takeda et al. |
| 9,984,801 | B2 * | 5/2018 | Takeda ..... C22C 38/02 |
| 2002/0011412 | A1 | 1/2002 | Blum et al. |
| 2002/0098345 | A1 | 7/2002 | Kamo et al. |
| 2007/0116963 | A1 * | 5/2007 | Sakakibara ..... B05D 7/16 428/414 |
| 2007/0224439 | A1 | 9/2007 | Holmberg |
| 2009/0233114 | A1 | 9/2009 | Takeda et al. |
| 2010/0139817 | A1 | 6/2010 | Montagnon |

FOREIGN PATENT DOCUMENTS

| | | | |
|---|---|---|---|
| CN | 1257136 | A | 6/2000 |
| JP | 50-15013 | A | 6/1975 |
| JP | 60-169567 | A | 9/1985 |
| JP | 3-36284 | A | 2/1991 |
| JP | 6-330338 | A | 11/1994 |
| JP | 11-80971 | A | 3/1999 |
| JP | 11-181577 | A | 7/1999 |
| JP | 2000-129455 | A | 5/2000 |
| JP | 2000-313967 | A | 11/2000 |
| JP | 2002-69657 | A | 3/2002 |
| JP | 2007-217758 | A | 8/2007 |
| WO | WO 01/68778 | A1 | 9/2001 |
| WO | WO 2007/003748 | A1 | 1/2007 |
| WO | WO 2007/136115 | A1 | 11/2007 |

OTHER PUBLICATIONS

Chinese Office Action dated Nov. 5, 2012 issued in corresponding Chinese Application No. 200981047568.3.

Extended European Search Report for European Application No. 09828970.5, dated Jul. 20, 2017.

U.S. Appl. No. 13/128,302, filed May 9, 2011.

* cited by examiner

*Primary Examiner* — Sheeba Ahmed

(74) *Attorney, Agent, or Firm* — Birch, Stewart, Kolasch & Birch, LLP

(57) ABSTRACT

An electrical steel sheet provides: a steel strip (1) for an electrical steel sheet; and an insulating film (2) formed at a surface of the steel strip (1) and containing metal phosphate and organic resin. At least a part of the metal phosphate includes at least one kind of crystal structure selected from a group consisting of a cubic system, a tetragonal system, a hexagonal system, and an orthorhombic system. The organic resin contains at least one kind selected from a group consisting of an acryl-based resin, an epoxy-based resin, and a polyester resin having a carboxyl group or a hydroxyl group at a surface of an emulsion particle for one part by mass to 50 parts by mass relative to 100 parts by mass of the metal phosphate.

6 Claims, 1 Drawing Sheet

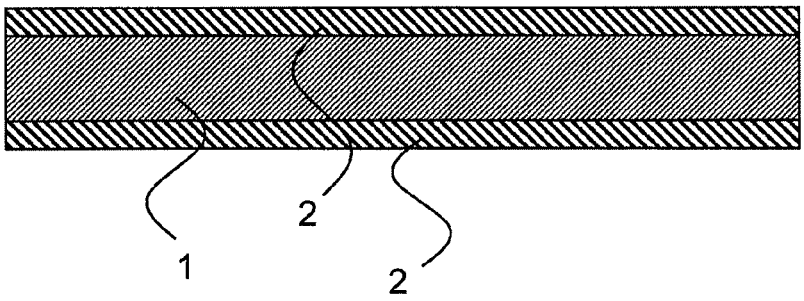
1
2
2

ELECTRICAL STEEL SHEET AND MANUFACTURING METHOD THEREOF

CROSS REFERENCE TO RELATED APPLICATIONS

This application is a Divisional of co-pending U.S. application Ser. No. 13/128,302 filed on May 9, 2011, which is a National Stage of PCT/JP2009/069109 filed on Nov. 10, 2009, which claims priority to Application No. 2008-302233 filed in Japan on Nov. 27, 2008. The entire contents of all of the above applications are hereby incorporated by reference.

TECHNICAL FIELD

The present invention relates to an electrical steel sheet and a manufacturing method thereof suitable for an iron core.

BACKGROUND ART

Joule heat is generated during a motor operates having an iron core including plural electrical steel sheets laminated with one another. Portions which are easily affected by heat such as an insulating film covering a copper wire, and a terminal of a copper wire are included in the motor, and therefore, it is desirable to effectively release the Joule heat.

On the other hand, an insulative coating film is generally provided at a surface of an electrical steel sheet. This is mainly to secure insulation performance of electrical steel sheets laminated with one another.

However, heat conductivity of a conventional insulative coating film is significantly low compared to heat conductivity of metal. Accordingly, in an iron core including plural electrical steel sheets laminated with one another, the heat is difficult to be transferred in a lamination direction of the electrical steel sheets. Recently, the state in which the heat is difficult to be transferred in the lamination direction becomes to be seen as a problem in accordance with diversification of a shape of a motor and so on.

CITATION LIST

Patent Literature

Patent Document 1: Japanese Laid-open Patent Publication No. S50-15013

Patent Document 2: Japanese Laid-open Patent Publication No. H03-36284

Patent Document 3: Japanese Laid-open Patent Publication No. H06-330338

Patent Document 4: Japanese Laid-open Patent Publication No. 2000-129455

Patent Document 5: Japanese Laid-open Patent Publication No. 2002-69657

Patent Document 6: Japanese Laid-open Patent Publication No. 2000-313967

Patent Document 7: Japanese Laid-open Patent Publication No. 2007-217758

Patent Document 8: Japanese Laid-open Patent Publication No. S60-169567

SUMMARY OF THE INVENTION

Technical Problem

An object of the present invention is to provide an electrical steel sheet and a manufacturing method thereof capable of improving heat conductivity.

Solution to Problem

An electrical steel sheet according to the present invention includes: a steel strip for an electrical steel sheet; and an insulating film formed at a surface of the steel strip and containing metal phosphate and an organic resin, wherein at least a part of the metal phosphate includes at least one kind of crystal structure selected from a group consisting of a cubic system, a tetragonal system, a hexagonal system, and an orthorhombic system, and the organic resin contains at least one kind selected from a group consisting of an acryl-based resin, an epoxy-based resin, and a polyester resin having a carboxyl group or a hydroxyl group at a surface of an emulsion particle for one part by mass to 50 parts by mass relative to 100 parts by mass of the metal phosphate.

Advantageous Effects of Invention

According to the present invention, it is possible to obtain high heat conductivity because an appropriate insulating film is provided.

BRIEF DESCRIPTION OF DRAWINGS

The FIGURE is a sectional view illustrating a structure of an electrical steel sheet according to an embodiment of the present invention.

DESCRIPTION OF EMBODIMENTS

Hereinafter, embodiments of the present invention are described in detail. The FIGURE is a sectional view illustrating a structure of an electrical steel sheet according to an embodiment of the present invention. In the present embodiment, insulating films 2 are formed on both surfaces of a steel strip 1 for an electrical steel sheet as illustrated in the FIGURE.

The steel strip 1 is a steel strip for, for example, a non-oriented electrical steel sheet. Besides, the steel strip 1 is preferable to contain, for example, Si: 0.1 mass % or more, and Al: 0.05 mass % or more. Note that electrical resistance becomes large and magnetic properties improve, on the other hand, brittleness increases as Si content is high. Accordingly, the Si content is preferable to be less than 4.0%. Besides, the magnetic properties improve, on the other hand, rolling properties deteriorate as Al content is high. Accordingly, the Al content is preferable to be less than 3.0%. The steel strip 1 may contain Mn of approximately 0.01 mass % to 1.0 mass %. It is preferable that all of contents of S, N and C in the steel strip 1 are, for example, less than 100 ppm, and more preferable to be less than 20 ppm.

The insulating film 2 contains metal phosphate and an organic resin. Besides, chromic acid is not contained in the insulating film 2. At least a part of the metal phosphate is crystallized, and a crystal structure of this portion is at least one kind from among a cubic system, a tetragonal system, a hexagonal system, and an orthorhombic system. Namely, at least a part of the metal phosphate includes at least one kind of crystal structure selected from a group consisting of the cubic system, the tetragonal system, the hexagonal system, and the orthorhombic system. A trigonal system is included in the hexagonal system. The organic resin contains an acryl-based resin, an epoxy-based resin, or a polyester resin having a carboxyl group or a hydroxyl group at a surface of an emulsion particle for one part by mass to 50 parts by mass relative to 100 parts by mass of the metal phosphate. The organic resin may contain a mixture or a copolymer of two kinds or three kinds from among these three kinds of resins for one part by mass to 50 parts by mass relative to 100 parts by mass of the metal phosphate.

The metal phosphate is obtained by drying, for example, water solution containing phosphoric acid and metal ions (metal phosphate solution). Kinds of phosphoric acid are not particularly limited, but for example, orthophosphoric acid, metaphosphoric acid, polyphosphoric acid, and so on are preferable. Kinds of metal ions are also not particularly limited, but for example, light metal such as Li, Al, Mg, Ca, Sr, and Ti are preferable. In particular, Al and Ca are preferable. It is preferable to use the one in which, for example, an oxide, a carbonate and/or a hydroxide of metal ion and so on are mixed to the orthophosphoric acid as the metal phosphate solution.

At least a part of the metal phosphate is to be crystallized, and it is not necessary that all of the metal phosphate is crystallized. Incidentally, it is preferable that 20 mass % or more of the metal phosphate is crystallized, and the crystal structure of the portion is at least one kind among the cubic system, the tetragonal system, the hexagonal system, and the orthorhombic system. It is more preferable that a portion of 50 mass % or more of the metal phosphate has the above-stated crystal structure. It is further preferable that a portion of 60 mass % or more of the metal phosphate has the above-stated crystal structure. Note that the cubic system and the orthorhombic system are preferable among the above-stated four kinds of crystal structures, and crystal structures belonging to a berlinite structure, a tridymite structure, and a cristobalite structure are mineralogically preferable. It is because higher heat conductivity can be obtained.

As stated above, there exist the carboxyl group or the hydroxyl group at the surface of the emulsion particle of the organic resin contained in the insulating film 2, but a method synthesizing the organic resin as stated above is not particularly limited. For example, a graft polymerization method can be used. Namely, a monomer having a predetermined functional group (the carboxyl group or the hydroxyl group) is coupled to a side chain which does not participate in a copolymerization reaction of a raw material of the acryl-based resin, the epoxy-based resin, or the polyester resin. As a result, it is possible to synthesize the acryl-based resin, the epoxy-based resin, or the polyester resin as stated above by the copolymerization reaction. A molecular structure of the acryl-based resin, the epoxy-based resin, or the polyester resin synthesized as stated above is, for example, linear or mesh. Note that a functional group to be the carboxyl group or the hydroxyl group by post-processing may be used as the predetermined functional group.

The acryl-based resin as stated above can be synthesized by copolymerizing, for example, a normal monomer which does not have a carboxyl group and a hydroxyl group with a monomer which has a carboxyl group or a hydroxyl group. For example, methyl acrylate, ethyl acrylate, n-butyl acrylate, i-butyl acrylate, n-octyl acrylate, i-octyl acrylate, 2-ethylhexyl acrylate, n-nonyl acrylate, n-decyl acrylate, n-dodecyl acrylate, and so on can be cited as the normal monomer. For example, acrylic acid, methacrylic acid, maleic acid, maleic anhydride, fumaric acid, crotonic acid, itaconic acid, citraconic acid, and cinnamic acid can be cited as the monomer having the carboxyl group. For example, 2-hydroxylethyl (meth)acrylate, 2-hydroxylpropyl (meth)acrylate, 3-hydroxylpropyl (meth)acrylate, 3-hydroxylbutyl (meth)acrylate, 4-hydroxylbutyl (meth)acrylate, 2-hydroxylethyl (meth)allylether, allyl alcohol, and so on can be cited as the monomer having the hydroxyl group.

The epoxy-based resin as stated above can be synthesized by, for example, reacting carboxylic anhydride with an epoxy resin denatured by amine (amine-denatured epoxy resin). For example, bisphenol-A diglycidyl ether, a ring-opening adduct of caprolactone of bisphenol-A diglycidyl ether, bisphenol-F diglycidyl ether, bisphenol-S diglycidyl ether, novolak glycidyl ether, hexahydrophthalic acid glycidyl ester, dimer acid glycidyl ether, tetraglycidylamino diphenylmethane, 3,4-epoxy-6-methylcyclohexyl methyl carboxylate, polypropylene glycidyl ether, and so on can be cited as the epoxy resin. For example, isopropanolamine, monopropanolamine, monobutanolamine, monoethanolamine, diethylenetriamine, ethylenediamine, butalamine, propylamine, isophoronediamine, tetrahydrofurfurylamine, xylenediamine, diaminediphenylmethane, diaminosulfone, octylamine, metaphenylenediamine, amylamine, hexylamine, nonylamine, decylamine, triethylenetetramine, tetramethylenepentamine, diaminodiphenylsulfone, and so on can be cited as the amine denaturing the epoxy resin. For example, succinic anhydride, itaconic anhydride, maleic anhydride, citraconic anhydride, phthalic anhydride, trimellitic anhydride, and so on can be cited as the carboxylic anhydride.

The polyester-based resin as stated above can be synthesized by, for example, obtaining copolymer polyester resin by copolymerizing dicarboxylic acid and glycol, and thereafter, graft polymerizing a predetermined monomer to the copolymer polyester resin. For example, terephthalic acid, isophthalic acid, orthophthalic acid, naphthalene dicarboxylic acid, biphenyl dicarboxylic acid, succinic acid, adipic acid, azelaic acid, sebacic acid, dodecanedionic acid, dimer acid, 1,4-cyclohexane dicarboxylic acid, fumaric acid, maleic acid, maleic anhydride, itaconic acid, citraconic acid, tetrahydrophthalic anhydride, and so on can be cited as the dicarboxylic acid. For example, ethylene glycol, 1,2-propylene glycol, 1,3-propanediol, 1,4-butanediol, 1,5-pentanediol, neopentyldiol, 1,6-hexanediol, 1,9-nonanediol, 1,4-cyclohexanedimethanol, diethylene glycol, triethylene glycol, dipropylene glycol, polyethylene glycol, and so on can be cited as the glycol. For example, acrylic acid, methacrylic acid, maleic acid, fumaric acid, itaconic acid, citraconic acid, maleic acid anhydride, itaconic acid anhydride, and methacrylic acid anhydride can be cited as the monomer graft polymerized to the copolymer polyester resin.

Note that a particle size of the emulsion particle of the organic resin is not particularly limited, but it is preferable that a median average particle size measured by a laser light scattering method is, for example, 0.2 μm to 0.6 μm.

Besides, it is not necessary that all of the organic resin in the insulating film 2 is the acryl-based resin, the epoxy-based resin, or the polyester resin having the carboxyl group or the hydroxyl group. For example, a resin which does not have the carboxyl group and the hydroxyl group may be contained in the organic resin. Incidentally, it is preferable that a ratio of the acryl-based resin, the epoxy-based resin, or the polyester resin having the carboxyl group or the hydroxyl group relative to a total amount of the organic resin is 30 mass % or more, and more preferable to be 70 mass % or more.

As stated above, the content of the organic resin is one part by mass to 50 parts by mass relative to 100 parts by mass of the metal phosphate. There is a possibility that the insulating film 2 may become mealy when the content of the organic resin is less than one part by mass, and adhesiveness after stress relieving annealing may deteriorate when the content exceeds 50 parts by mass.

High heat conductivity can be obtained in the electrical steel sheet constituted as stated above. The reason thereof is not clear, but it is conceivable that one of the reasons is that density of the metal phosphate of which crystal structure is the cubic system, the tetragonal system, the hexagonal system, or the orthorhombic system is high. Besides, it is conceivable that it is also one of the reasons that wettability with the metal phosphate is good because the carboxyl group or the hydroxyl group exists at the surface of the emulsion particle of the organic resin. Namely, as it is described later, the coating film of the insulating film 2 is dried at the formation time of the insulating film 2, and therefore, thermal expansion or thermal contraction occurs at the organic resin, and it is conceivable that it is one of the reasons that high adhesiveness is secured because a gap is difficult to be generated between the organic resin and the metal phosphate at this time.

Note that the insulating film 2 is preferable to be an organic film because baking at high temperature is necessary, and productivity is low to use an inorganic film as the insulating film 2.

Next, a manufacturing method of an electrical steel sheet according to the embodiment of the present invention is described.

First, the steel strip 1 for an electrical steel sheet is manufactured. In the manufacturing of the steel strip, for example, hot rolling of a slab having a predetermined component is performed, a hot-rolled steel sheet obtained by the hot rolling is rolled up in a coil state. Next, cold rolling of the hot-rolled steel sheet is performed to obtain a cold-rolled steel sheet. A thickness of the cold-rolled steel sheet is, for example, approximately 0.15 mm to 0.5 mm. After that, annealing is performed. Note that another annealing may be performed at approximately 800° C. to 1050° C. between the hot rolling and the cold rolling.

Note that surface roughness of the steel strip is preferable to be low. It is because the good adhesiveness can be obtained at laminating the electrical steel sheets. Specifically, centerline average roughness Ra in both directions of a rolling direction and a direction orthogonal to the rolling direction are preferable to be 1.0 μm or less, and more preferable to be 0.5 μm or less. When the average roughness Ra exceeds 1.0 μm, there is a case when the good adhesiveness is not obtained, and the high heat conductivity is not obtained. Note that when the average roughness Ra is set to be less than 0.1 μm, a cost is easy to increase drastically. It is necessary to make a surface of a cold rolling roll extremely smooth, and a high cost is required for the smoothing.

Besides, a raw material of the insulating film 2 is manufactured. In the manufacturing of the raw material, a solution of the mixture of the above-stated metal phosphate and the organic resin is manufactured, and polyhydric alcohol compound is added to the solution. The polyhydric alcohol compound is a low-molecular organic compound having two or more hydroxyl groups. For example, ethylene glycol, diethylene glycol, triethylene glycol, tetraethylene glycol, propylene glycol, 1,6-hexyanediol, glycerin, polyprene glycol, sucrose, and so on can be cited as the polyhydric alcohol compound. Note that a ratio of the organic resin is one part by mass to 50 parts by mass relative to 100 parts by mass of the metal phosphate when it is converted into a resin solid content.

An addition amount of the polyhydric alcohol compound is preferable to be one part by mass to 20 parts by mass relative to 100 parts by mass of the metal phosphate. It is because an effect according to the addition is difficult to be expressed when the addition amount of the polyhydric alcohol compound is less than one part by mass, and a temperature range capable of drying the coating film for the formation of the insulating film 2 becomes narrow when the addition amount exceeds 20 parts by mass.

Further, it is preferable that a nucleation agent is added to the solution of the mixture of the metal phosphate and the organic resin. For example, an oxide based nucleation agent such as talc, magnesium oxide, titanium oxide, and a sulfate based nucleation agent such as barium sulfate can be cited as the nucleation agent. A size of the nucleation agent is not particularly limited, but it is preferable that the median average particle size measured by the laser light scattering method is, for example, 0.1 μm to 2 μm. Besides, it is preferable that the nucleation agent is hardly soluble.

The metal phosphate is easy to be crystallized by the addition of the nucleation agent, and therefore, it is possible to crystallize the metal phosphate at a lower baking temperature compared to a case when the nucleation agent is not added. Besides, the crystal structure is easy to be the cubic system, and the high heat conductivity is easy to be obtained compared to the case when the nucleation agent is not added under the common baking temperature.

An addition amount of the nucleation agent is preferable to be 0.1 parts by mass to five parts by mass relative to 100 parts by mass of the metal phosphate. It is because an effect according to the addition is difficult to be expressed when the addition amount of the nucleation agent is less than 0.1 parts by mass, and it is easy to be mealy at a punching time when the addition amount exceeds five parts by mass.

A treatment solution in which the solution of the mixture and the polyhydric alcohol compound are contained, and the nucleation agent is added according to need is manufactured as stated above. The treatment solution does not contain the chromic acid.

A coating film of the treatment solution is formed at the surface of the steel strip after the steel strip and the treatment solution are manufactured. A coating amount of the treatment is not particularly limited, but it is solution preferable to be 0.5 $g/m^2$ to 4.0 $g/m^2$. This is because a control of a crystallization rate is difficult when the coating amount is less than 0.5 $g/m^2$ since the crystallization of the metal phosphate is easy to proceed, and a tendency that the adhesiveness of the electrical steel sheets with each other is lowered becomes remarkable when the coating amount exceeds 4.0 $g/m^2$.

After the formation of the coating film, baking of the coating film is performed. Namely, the coating film is heated and dried. A heating rate at this time is, for example, 25° C./sec to 65° C./sec. Productivity becomes low when the heating rate is less than 25° C./sec, and the crystal structure of the metal phosphate is difficult to be the cubic system, the tetragonal system, the hexagonal system, and the orthorhombic system when the heating rate exceeds 65° C./sec. A baking temperature (retention temperature) is, for example, 200° C. to 360° C. Water resistance and so on are low because polymerization reaction of the metal phosphate is difficult to proceed when the baking temperature is less than 200° C., and there is a possibility that the organic resin is oxidized and the productivity is lowered when the baking temperature exceeds 360° C. Besides, it is preferable that a lower limit of the baking temperature is set to be 210° C., and more preferable to be 230° C. This is because the crystal structure of the metal phosphate is easier to be the cubic system, the tetragonal system, the hexagonal system, and the orthorhombic system. A retention time at the baking temperature is, for example, for 10 seconds to 30 seconds. The crystal structure of the metal phosphate is difficult to be the cubic system, the tetragonal system, the hexagonal system, and the orthorhombic system when the retention time is less than 10 seconds, and the productivity is lowered when the retention time exceeds 30 seconds. A cooling rate is, for example, 20° C./sec to 85° C./sec until 100° C. The productivity is lowered when the cooling rate is less than 20° C./sec, and the good heat conductivity is difficult to be obtained because the metal phosphate is difficult to be crystallized and easy to be amorphous when the cooling rate exceeds 85° C./sec.

A coating method of the treatment solution to the surface of the steel strip is not particularly limited. For example, the treatment solution may be coated by using a roll coater, the treatment solution may be coated by using a spray, and the steel strip may be immersed in the treatment solution.

A baking method of the coating film is also not particularly limited. For example, the baking may be performed by using a radiation furnace, the baking may be performed by using an electric furnace such as an induction heater. The baking by using the induction heater is preferable from a point of view of accuracy of controlling the heating rate.

Note that a surfactant and so on may further be added to the treatment solution. A nonionic surfactant is preferable as the surface active agent. In addition, a brightening agent and so on may be added.

Next, experiments performed by the present inventors are described.

In this experiment, a steel strip for a non-oriented electrical steel sheet containing Si: 2.5%, Al: 0.5%, and Mn: 0.05%, and of which thickness was 0.35 mm was manufactured.

Besides, eight kinds of water solutions of the phosphate (metal phosphate) listed in table 1 were manufactured. Note that the nucleation agent was added to the phosphates of No. 1, No. 4, and No. 6 as listed in the table 1. Talc of which average particle size was 1.0 μm was used, and barium sulfate of which average particle size was 0.5 μm was used. A mixture of substances listed in the table 1 was diffused in water when the phosphate solution was manufactured. Concentration of the phosphate solution was set to be 40 mass %. Note that solubility of manganese phosphate (phosphate No. 7) and iron phosphate (phosphate No. 8) is low. Accordingly, pH of the solution was set to be five or less by mixing orthophosphoric acid for approximately five mass % more than an amount of the phosphate determined by a stoichiometry when these solutions were manufactured.

TABLE 1

| | | PHOSPHORIC ACID | | METAL COMPOUND | | NUCLEATION AGENT | |
|---|---|---|---|---|---|---|---|
| PHOSPHATE NO. | NAME | KIND | PART BY MASS | KIND | PART BY MASS | KIND | PART BY MASS |
| 1 | LITHIUM PHOSPHATE | ORTHO-PHOSPHORIC ACID | 100 | LiOH | 73.2 | TALC | 3.5 |
| 2 | MAGNESIUM PHOSPHATE | | | $Mg(OH)_2$ | 89.2 | NONE | |
| 3 | ALUMINUM PHOSPHATE | | | $Al(OH)_3$ | 79.5 | NONE | |
| 4 | STRONTIUM PHOSPHATE | | | $Sr_2CO_3$ | 352.8 | BARIUM SULFATE | 2.0 |
| 5 | CALCIUM PHOSPHATE | | | $CaCO_3$ | 153.1 | NONE | |
| 6 | NICKEL PHOSPHATE | | | $Ni(OH)_2$ | 141.8 | TALC | 2.0 |
| 7 | MANGANESE PHOSPHATE | | | $Mn(OH)_2$ | 136.1 | NONE | |
| 8 | IRON PHOSPHATE | | | $Fe(OH)_3$ | 160.3 | NONE | |

Besides, 30 mass % emulsion solutions or 30 mass % dispersion solutions of seven kinds of organic resins as listed below were manufactured. The 30 mass % dispersion solution was manufactured by forced stirring. Note that an average particle size of each organic resin is the median average particle size measured by the laser light scattering method.

(1) Acryl-Based Resin-1 (Average Particle Size: 0.35 μm)

An acryl-based resin having the hydroxyl group was manufactured by copolymerizing 2-hydroxyletheyl (meth) acrylate (10 mass %) as the monomer having the hydroxyl group, and styrene monomer (30 mass %), methyl methacrylate (50 mass %), and methyl acrylate (10 mass %) as the normal monomers.

(2) Acryl-Based Resin-2 (Average Particle Size: 0.22 μm)

An acryl-based resin having the carboxyl group was manufactured by copolymerizing fumaric acid (15 mass %) as the monomer having the carboxyl group, and methyl acrylate (30 mass %), butyl acrylate (35 mass %), and styrene monomer (20 mass %) as the normal monomers.

(3) Epoxy-Based Resin (Average Particle Size: 0.15 μm)

An amine-denatured epoxy resin was manufactured by denaturing bisphenol-A epoxy resin with monoethanolamine, and thereafter, succinic anhydride was graft polymerized with the amine-denatured epoxy resin to manufacture an epoxy-based resin having the carboxyl group.

(4) Polyester-Based Resin (Average Particle Size: 0.10 μm)

A copolymer polyester resin was manufactured by copolymerizing dimethyl terephthalate (40 mass %) and neopentyl glycol (40 mass %), and thereafter, fumaric acid (10 mass %) and trimellitic anhydride (10 mass %) were graft polymerized with the copolymer polyester resin, to manufacture a polyester-based resin having the carboxyl group.

(5) Acryl-Based Resin-3 (Average Particle Size: 0.20 μm)

An acryl-based resin which did not have the carboxyl group and the hydroxyl group was manufactured by copolymerizing methyl acrylate (50 mass %), styrene monomer (20 mass %), and butyl acrylate (30 mass %).

(6) Polyurethane (Average Particle Size: 0.16 μm) Polyurethane was synthesized by a known method.

(7) Phenol Resin (Average Particle Size: 0.12 μm)

A resole-type phenol resin water-system emulsion is prepared.

The polyhydric alcohol compound was accordingly added to the organic resin solution. Next, the solution and the above-stated phosphate solutions were mixed to manufacture 24 kinds of treatment solutions listed in Table 2. After that, the treatment solution was coated on the surface of the above-stated steel strip by using the roll coater to form the coating film. At this time, an amount of roll draft and so on was adjusted so that the coating amount became 2 g/m2. Subsequently, the drying and the baking of the coating film were performed by using the radiation furnace. The conditions are also listed in the table 2.

Evaluations of the heat conductivity, a space factor, the adhesiveness, a corrosion resistance, an external appearance, a crystal system, and a crystallinity of the obtained non-oriented electrical steel sheets were performed.

In the evaluation of the heat conductivity, 50 pieces of samples of 30 mm square were cut out from the respective non-oriented electrical steel sheets, and they were laminated. Next, a periphery of the laminated body was surrounded by a heat insulator, and the laminated body was pressurized and adhered on a heating element of 200° C. with a pressing force of 200 N/cm2 (20 kgf/cm2). A temperature of the sample positioning at the top portion of the laminated body was measured. The temperature increased toward 200° C. as time elapsed, but saturated at a temperature of less than 200° C. when about 60 minutes elapsed. A difference between the temperature at this time and the temperature of the heating element (200° C.) was found. The temperature differences were listed in table 3. It can be said that the heat conductivity is high as the temperature difference is small.

The space factors were measured based on JIS C 2550. These results are also listed in the table 3.

In the evaluation of the adhesiveness, stress relieving annealing at 750° C. for 2 hours in a nitrogen atmosphere was performed for each non-oriented electrical steel sheet. Next, an adhesive tape was adhered to the sample of each non-oriented electrical steel sheet, and this was folded around each of metal bars of which diameters were 10 mm, 20 mm, and 30 mm. After that, the adhesive tape was peeled off from each sample, and a peeled state of the insulating film was observed. The sample of which insulating film was not peeled off even when the sample was folded around the

TABLE 2

| | | TREATMENT SOLUTION | | | | | CONDITIONS OF DRYING, BAKING | | | |
|---|---|---|---|---|---|---|---|---|---|---|
| | | | ORGANIC RESIN | | POLYHYDRIC ALCOHOL COMPOUND | | | | | |
| | No. | PHOSPHATE No. | KIND | PART BY MASS | KIND | PART BY MASS | HEATING RATE (° C./SEC) | RETENTION TEMPERATURE (° C.) | RETENTION TIME (SEC) | COOLING RATE (° C./SEC) |
| EXAMPLE | 1 | 1 | ACRYL-BASED RESIN-1 | 32 | EG | 16 | 35 | 300 | 20 | 40 |
| | 2 | 2 | ACRYL-BASED RESIN-1 | 12 | GL | 19 | 55 | 280 | 20 | 40 |
| | 3 | 2 | EPOXY-BASED RESIN | 22 | EG | 10 | 45 | 280 | 25 | 35 |
| | 4 | 3 | POLYESTER-BASED RESIN | 24 | GL | 18 | 35 | 280 | 28 | 70 |
| | 5 | 3 | ACRYL-BASED RESIN-1 | 33 | GL | 17 | 50 | 330 | 15 | 40 |
| | 6 | 3 | ACRYL-BASED RESIN-2 | 33 | GL | 12 | 30 | 230 | 12 | 63 |
| | 7 | 4 | ACRYL-BASED RESIN-2 | 38 | SU | 14 | 26 | 350 | 28 | 83 |
| | 8 | 6 | EPOXY-BASED RESIN | 21 | GL | 11 | 63 | 220 | 28 | 20 |
| | 9 | 5 | ACRYL-BASED RESIN-1 | 2 | EG | 4 | 25 | 350 | 12 | 80 |
| | 10 | 7 | ACRYL-BASED RESIN-2 | 48 | SU | 8 | 30 | 300 | 20 | 75 |
| | 11 | 4 | EPOXY-BASED RESIN | 8 | EG | 1.5 | 60 | 280 | 20 | 55 |
| COMPARATIVE EXAMPLE | 12 | 1 | ACRYL-BASED RESIN-3 | 32 | GL | 19 | 35 | 300 | 20 | 35 |
| | 13 | 8 | PHENOL RESIN | 40 | GL | 18 | 30 | 300 | 23 | 35 |
| | 14 | 5 | POLYURETHANE | 40 | GL | 13 | 30 | 300 | 23 | 35 |
| | 15 | 7 | ACRYL-BASED RESIN-3 | 32 | GL | 9 | 35 | 250 | 22 | 40 |
| | 16 | 1 | ACRYL-BASED RESIN-3 | 32 | GL | 1 | 35 | 320 | 20 | 35 |
| | 17 | 1 | ACRYL-BASED RESIN-3 | 32 | EG | 16 | 20 | 320 | 20 | 55 |
| | 18 | 3 | EPOXY-BASED RESIN | 22 | GL | 14 | 70 | 320 | 20 | 35 |
| | 19 | 2 | POLYESTER-BASED RESIN | 33 | EG | 9 | 35 | 150 | 28 | 55 |
| | 20 | 4 | POLYESTER-BASED RESIN | 33 | EG | 7 | 35 | 430 | 23 | 35 |
| | 21 | 7 | ACRYL-BASED RESIN-3 | 32 | GL | 18 | 40 | 240 | 45 | 7 |
| | 22 | 2 | ACRYL-BASED RESIN-1 | 54 | SU | 8 | 50 | 350 | 30 | 20 |
| | 23 | 2 | ACRYL-BASED RESIN-1 | 20 | SU | 23 | 50 | 320 | 30 | 20 |
| | 24 | 5 | EPOXY-BASED RESIN | 22 | NONE | | 40 | 240 | 8 | 88 |

EG: ETHYLENE GLYCOL,
GL: GLYCERIN,
SU: SUCROSE metal bar of which diameter was 10 mm was evaluated as "10 mmφOK". The sample of which insulating film was not peeled off when the sample was folded around the metal bar of which diameter was 20 mm was evaluated as "20 mmφOK". The sample of which insulating film was not peeled off when the sample was folded around the metal bar of which diameter was 30 mm was evaluated as "30 mmφOK". Besides, the sample of which insulating film was peeled off when the sample was folded around the metal bar of which diameter was 30 mm was evaluated as "30 mmφNG". The results are also listed in the table 3.

The evaluation of the corrosion resistance was performed based on a salt spray test of JIS Z 2371. Namely, 10 points evaluation was performed after seven hours elapsed from the spray of salt water as for each sample of the non-oriented electrical steel sheet. The sample which did not get rusty was evaluated as "10", the sample which got a little rusty (an area ratio of a portion where the rust occurs was 0.1% or less) was evaluated as "9". Besides, the sample of which area ratio of the rusty portion was more than 0.1% and 0.5% or less was evaluated as "8", more than 0.5% and 1.0% or less was "7", more than 1.0% and 3.0% or less was "6", more than 3.0% and 10% or less was "5", more than 10% and 20% or less was "4", more than 20% and 30% or less was "3", more than 30% and 40% or less was "2", and more than 40% and 50% or less was "1". The results are also listed in the table 3.

The evaluation of the external appearance was performed by visual observation. Namely, the sample which was glossy, smooth and uniform was evaluated as "5", the sample which was glossy but of which uniformity was a little low was "4". Besides, the sample which was a little glossy and smooth but of which uniformity was low was "3", the sample which was less glossy, of which smoothness was a little low, and uniformity was low was "2", and the sample of which glossiness, uniformity and smoothness were low was "1". The results are also listed in the table 3.

In the evaluations of the crystal system and the crystallinity, RINT-2000 manufactured by Rigaku Corporation was used, a comparison between a peak position and intensity of each sample of the non-oriented electrical steel sheet and a peak position and intensity of a standard sample was performed by an X-ray diffractometry, to identify the crystal structure and the crystallinity of the metal phosphate. Note that it was judged that the insulating film was made up of amorphous when peak intensity derived from the metal phosphate enough for analysis could not be obtained. Besides, a rate of crystallization (crystallinity) was determined by a profile fitting method from a chart obtained by the X-ray diffractometry. The results are also listed in the table 3.

TABLE 3

| | No. | HEAT CONDUCTIVITY (° C.) | SPACE FACTOR (%) | ADHESIVENESS | CORROSION RESISTANCE | EXTERNAL APPEARANCE | CRYSTAL SYSTEM | CRYSTALLINITY (%) |
|---|---|---|---|---|---|---|---|---|
| EXAMPLE | 1 | 14.4 | 99.0 | 20 mm φ OK | 10 | 5 | CUBIC | 45.4 |
| | 2 | 14.0 | 99.0 | 20 mm φ OK | 10 | 5 | CUBIC | 26.0 |
| | 3 | 18.3 | 98.8 | 20 mm φ OK | 9 | 5 | ORTHORHOMBIC | 24.0 |
| | 4 | 17.8 | 99.4 | 10 mm φ OK | 10 | 5 | ORTHORHOMBIC | 21.0 |
| | 5 | 19.5 | 98.6 | 20 mm φ OK | 10 | 4 | ORTHORHOMBIC | 54.3 |
| | 6 | 15.2 | 98.7 | 20 mm φ OK | 9 | 5 | HEXAGONAL | 36.4 |
| | 7 | 21.1 | 98.7 | 20 mm φ OK | 9 | 4 | CUBIC AND ORTHORHOMBIC | 61.5 |
| | 8 | 15.0 | 98.5 | 20 mm φ OK | 9 | 5 | CUBIC AND ORTHORHOMBIC | 63.2 |
| | 9 | 16.1 | 98.7 | 20 mm φ OK | 9 | 5 | TETRAGONAL | 24.1 |
| | 10 | 15.3 | 99.0 | 20 mm φ OK | 10 | 5 | CUBIC AND ORTHORHOMBIC | 23.7 |
| | 11 | 16.1 | 91.6 | 20 mm φ OK | 10 | 5 | CUBIC AND ORTHORHOMBIC | 37.5 |
| COMPARATIVE EXAMPLE | 12 | 31.5 | 98.1 | 20 mm φ OK | 4 | 3 | AMORPHOUS | |
| | 13 | 27.3 | 98.1 | 30 mm φ OK | 6 | 4 | MONOCLINIC | 16.3 |
| | 14 | 26.5 | 99.0 | 30 mm φ NG | 7 | 4 | MONOCLINIC | 13.3 |
| | 15 | 29.1 | 98.7 | 30 mm φ NG | 7 | 2 | TRICLINIC | 13.2 |
| | 16 | 32.5 | 98.6 | 30 mm φ OK | 4 | 3 | AMORPHOUS | |
| | 17 | 30.4 | 99.1 | 20 mm φ OK | 4 | 3 | AMORPHOUS | |
| | 18 | 33.6 | 98.5 | 30 mm φ NG | 6 | 3 | AMORPHOUS | |
| | 19 | 33.5 | 99.0 | 30 mm φ OK | 3 | 3 | AMORPHOUS | |
| | 20 | 31.8 | 98.4 | 30 mm φ OK | 4 | 3 | AMORPHOUS | |
| | 21 | 28.4 | 99.1 | 30 mm φ NG | 6 | 4 | MONOCLINIC | 10.4 |
| | 22 | 30.1 | 98.3 | 30 mm φ OK | 7 | 4 | AMORPHOUS | |
| | 23 | 32.6 | 99.1 | 30 mm φ OK | 3 | 3 | MONOCLINIC | 14.1 |
| | 24 | 29.5 | 99.1 | 30 mm φ OK | 6 | 3 | AMORPHOUS | |

As it is obvious from the table 3, in each of examples No. 1 to No. 11 belonging to a range of the present invention, the good heat conductivity was obtained, and further, the space factor, the adhesiveness, the corrosion resistance, and the external appearance were also good. On the other hand, in each of comparative examples No. 12 to No. 24 which were out of the range of the present invention, none of the crystal structures of the cubic system, the tetragonal system, the hexagonal system, and the orthorhombic system exist, and the good heat conductivity could not be obtained. Besides, there was a case when the adhesiveness, the space factor, the corrosion resistance, and the external appearance were not good.

Note that the present invention is not limited to the above-stated embodiments, examples, and so on.

INDUSTRIAL APPLICABILITY

The present invention can be used in, for example, an electrical steel sheet manufacturing industry and an electrical steel sheet using industry.

The invention claimed is:

1. A manufacturing method of an electrical steel sheet, comprising:

coating a treatment solution containing metal phosphate, an organic resin, and a polyhydric alcohol compound at a surface of a steel strip for an electrical steel sheet;

performing a baking of the treatment solution so as to form an insulating film in which at least a part of the metal phosphate includes at least one kind of crystal structure selected from a group consisting of a cubic system, a tetragonal system, a hexagonal system, and an orthorhombic system, wherein the treatment solution contains:

at least one kind selected from a group consisting of an acryl-based resin, an epoxy-based resin, and a polyester resin having a carboxyl group or a hydroxyl group at a surface of an emulsion particle for one part by mass to 50 parts by mass relative to 100 parts by mass of the metal phosphate when it is converted into a resin solid content, as the organic resin; and the polyhydric alcohol compound for one part by mass to 20 parts by mass relative to 100 parts by mass of the metal phosphate, and wherein the performing the baking of the treatment solution includes:

heating the steel strip to which the treatment solution is coated up to 230° C. to 360° C. with a rate of 25° C./sec to 65° C./sec;

next retaining the steel strip at the temperature of 230° C. to 360° C. for 10 seconds to 30 seconds; and next cooling the steel strip to 100° C. with a rate of 20° C./sec to 85° C./sec.

2. The manufacturing method of an electrical steel sheet according to claim 1, wherein the steel strip is for a non-oriented electrical steel sheet.

3. The manufacturing method of an electrical steel sheet according to claim 1, wherein 20 mass percent or more of the metal phosphate includes the at least one kind of crystal structure.

4. The manufacturing method of an electrical steel sheet according to claim 1, wherein 50 mass percent or more of the metal phosphate includes the at least one kind of crystal structure.

5. The manufacturing method of an electrical steel sheet according to claim 1, wherein at least a part of the metal phosphate includes a crystal structure of the cubic system or the orthorhombic system.

6. The manufacturing method of an electrical steel sheet according to claim 1, wherein the treatment solution does not contain chromic acid.

* * * * *